United States Patent [19]

Barrabès

[11] Patent Number: 4,611,876

[45] Date of Patent: Sep. 16, 1986

[54] GENERAL PURPOSE LOSS-PROOF TERMINAL FOR FORMING ELECTRIC CONNECTIONS BY CLAMPING BETWEEN TWO CONDUCTING ELEMENTS

[75] Inventor: Claude Barrabès, Cauge, France

[73] Assignee: La Telemecanique Electrique, France

[21] Appl. No.: 686,558

[22] Filed: Dec. 26, 1984

[30] Foreign Application Priority Data

Dec. 30, 1983 [FR] France ..... 83 21084

[51] Int. Cl.[4] ..... H01R 4/30

[52] U.S. Cl. ..... 339/263 R; 339/198 R; 339/246

[58] Field of Search ..... 339/263, 272 A, 243, 339/244 VC, 242, 246, 249 A, 272 VC, 198 R, 198 G, 198 GA

[56] References Cited

U.S. PATENT DOCUMENTS

| | | | |
|---|---|---|---|
| 2,397,102 | 3/1946 | Graham | 339/198 G |
| 3,083,348 | 3/1963 | Crowther | 339/263 R |
| 3,238,495 | 3/1966 | Lanius | 339/198 R |
| 3,470,526 | 9/1969 | Joly | 339/263 R |
| 3,994,556 | 11/1976 | Jensen et al. | 339/263 R |
| 4,123,132 | 10/1978 | Hardy et al. | 339/263 R |
| 4,273,408 | 6/1981 | Orr | 339/198 G |

FOREIGN PATENT DOCUMENTS

| | | | |
|---|---|---|---|
| 2432779 | 4/1980 | France | 339/198 R |
| 0815801 | 3/1981 | U.S.S.R. | 339/263 R |

*Primary Examiner*—Gil Weidenfeld
*Assistant Examiner*—David L. Pirlot
*Attorney, Agent, or Firm*—William A. Drucker

[57] ABSTRACT

A loss proof general purpose terminal for forming electric connections by clamping between two conducting elements, comprising a connection area disposed at the bottom of a recess formed in an insulating material body and having a central tapped bore, a clamping screw for screwing into said bore and a stirrup portion mounted so as not to be lost under the head of the screw. It further comprises, guided inside the recess a stirrup-plate having a threaded bore through which said screw is screwed. This stirrup-plate comprises two diametrically opposite lateral projections extending at right angles and whose ends are bent back inwardly and extend partially into the passage zone of said stirrup portion.

7 Claims, 13 Drawing Figures

GENERAL PURPOSE LOSS-PROOF TERMINAL FOR FORMING ELECTRIC CONNECTIONS BY CLAMPING BETWEEN TWO CONDUCTING ELEMENTS

BACKGROUND OF THE INVENTION

1. Field of the Invention

The present invention relates to a general purpose loss-proof terminal for forming electric connections by clamping between two conducting elements such for example as an electric wire and a connection area of an electric apparatus.

2. Description of the Prior Art

It is generally known that, in the present state of the technique, there exist at least two main types of terminals for forming such connections.

The first type of terminal, generally called "stirrup" terminals, does not require any particular preparation of the end of the electric wire where the connection is to be made, unless it is simply bared in the case where the electric wire is covered with an insulating sheath. In this first type of terminal, the connecting area is disposed at the bottom of a recess formed in an insulating material body forming a guide cage, and has a tapped bore (or even a smooth bore at right angles to which is disposed a nut) in which is screwed a clamping screw equipped with a stirrup connection. Usually, this stirrup connection of a width essentially equal to that of the recess, is fitted so that it cannot be lost under the head of the screw (between head and screw thread). Thus, to make a connection with an electric wire, the screw is unscrewed then the end of the wire, bared if required, is introduced into the free gap between the connecting area and the stirrup connection. Then the screw is screwed up tight until the end of the wire is suitably compressed between the stirrup and the connecting plate. So that the assembly formed by the screw and its stirrup portion cannot be lost, the recess comprises, preferably at the level of the opening through which screwing up takes place, a narrowed portion which is either integrally molded therewith or formed by an added element such as a cap.

Thus, at the end of screwing out, the stirrup portion comes into abutment against the narrow portion of the recess and is thus blocked so that it cannot be lost.

The second type of terminal, generally called cage terminals, comprises a clamping cage open at least at one of its ends so as to allow a connecting tag or possibly the end of a wire to pass therethrough and a face having a tapped bore in which is screwed a screw; As before, this cage is mounted inside a recess formed in an insulating material body. So that the screw cannot be lost, this recess has, at the level of the opening through which screwing up takes place, a narrow portion in which the head of the screw comes into abutment at the end of screwing out.

It can be seen that these two types of terminals are not suitable for connecting wires equipped with closed connecting tags whose use is imposed by certain regulations and which have a hole through which the clamping screw must necessarily pass.

In fact, in the case of a stirrup terminal, it would be necessary, in order to fit the connecting tag, to previously remove the screw-stirrup assembly, which is incompatible with the loss proof nature of this fitting.

Moreover, the disadvantage of cage terminals comes from the fact that, because of stresses exerted during tightening of the screw, the cage must necessarily have relatively thick walls. Consequently, the width of the internal volume of the connecting tag and so the width of the tag used will be appreciably less than the width of the recess, which is usually imposed for reasons of space, in particular in the case where several identical terminals are juxtaposed. It is clear that the use of closed connecting tags in such terminals would be contrary to the spirit of the regulations which impose the use of closed connecting tags, for in the case of poor clamping, the connection is not properly held.

SUMMARY OF THE INVENTION

The aim of the invention is to overcome these drawbacks. It provides more particularly a general purpose connection terminal able to receive all sorts of conductors, not only electric wires without particular preparation, but also wires equipped with open or closed connecting tags of maximum width, this terminal being further equipped with means ensuring that its component parts cannot be lost.

To reach these results, the terminal of the invention first of all comprises, in a conventional way: a connection area disposed at the bottom of a recess formed in an insulating material body and having a central bore associated with screwing means; a clamping screw intended to pass through said bore for screwing into said screwing means and a stirrup portion, preferably mounted in a loss proof way, under the head of the screw, between head and screw thread.

This terminal further comprises a stirrup-plate having a tapped hole through which said screw is screwed, this stirrup-plate being equipped with retention means comprising at least one part forming an abutment against which the stirrup or the head of the screw bears after screwing out of the screw from the connection area. In this latter position, the screw which is still screwed by its end into the tapped bore of the stirrup-plate cannot free itself because of the abutment which prevents any further unscrewing. Moreover, said recess comprises a narrowed opening for preventing the mobile assembly, formed by the screw, the stirrup portion, the stirrup-plate and the retention means, from escaping.

The above described terminal has multiple possibilities of use. It is suitable for connecting closed connecting tags, which, in the unscrewed position of the screw, may be engaged between the connection area and the stirrup-plate, then be tightened by screwing up the screw, this latter then passing through the bore in the tag. It may also receive, in a similar way, one or more electric wires without particular preparation.

In another mode of use, the electric wires may be introduced between the stirrup portion and the stirrup-plate, then be clamped between these two parts. This solution facilitates the introduction of the wires because of the mobility inside the recess of the assembly formed by the screw, the stirrup portion and the stirrup-plate in the closed position of the screw.

The retention means associated with the stirrup-plate may be very varied. They may for example consist of at least one lateral extension of the stirrup-plate, which extends substantially at right angles and comprises at its end a bent back portion extending into the passage volume of the stirrup portion and/or of the head of the screw, so as to limit its axial travel at the end of unscrewing when the screw is freed from the screw threads of the connection area.

In an advantageous embodiment of the invention, the stirrup-plate comprises two diametrically opposite lateral extensions and thus has a U shape, both ends of which are bent back inwardly and extend partially into the passage zone of the stirrup portion and/or of the head of the screw.

BRIEF DESCRIPTION OF THE DRAWINGS

Embodiments of the invention will be described hereafter, by way of non limitative examples, with reference to the accompanying drawings in which.

DESCRIPTION OF THE PREFERRED EMBODIMENTS

As mentioned above, the terminal of the invention applies to the connection of conducting elements of various shapes and types. Among them, there has been simply shown in FIGS. 1 and 2 the conductors which are the most useful for understanding the operation of the terminal and the advantages which it provides.

Figure 1:
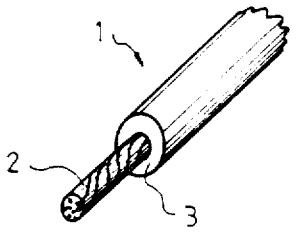
FIGS. 1 and 2 show, in a perspective view, the end of two electric wires, namely an electric wire which has been simply bared (FIG. 1) and a wire equipped with a closed tag (FIG. 2)
Figure 2:
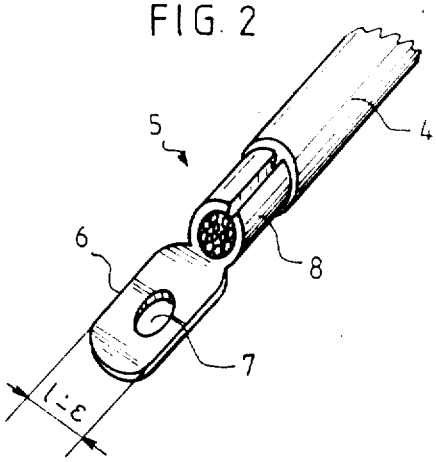

Thus, FIG. 1 shows an electric wire 1 with multistrand conductors 2 enclosed in an electrically insulating sheath 3 and whose end has been bared for connection thereof. FIG. 2 shows an electric wire 4 of a type similar to the preceding one, but equipped with a closed tag 5 having a flat substantially rectangular connecting lug 6 pierced with a central bore 7 and having a collar 8 fixed by clamping onto the bared part of the electric wire 4.

Figure 3:
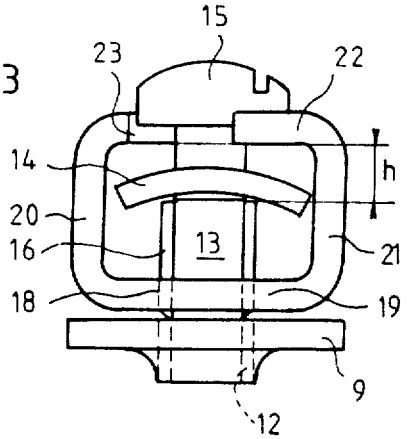
FIGS. 3 and 4 show, in a side view (FIG. 3) and a top view (FIG. 4), the component elements of a loss proof general purpose terminal of the invention.
Figure 4:
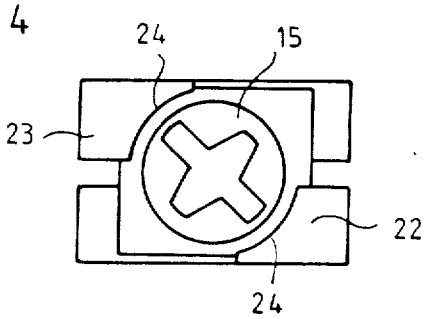
Figure 5:
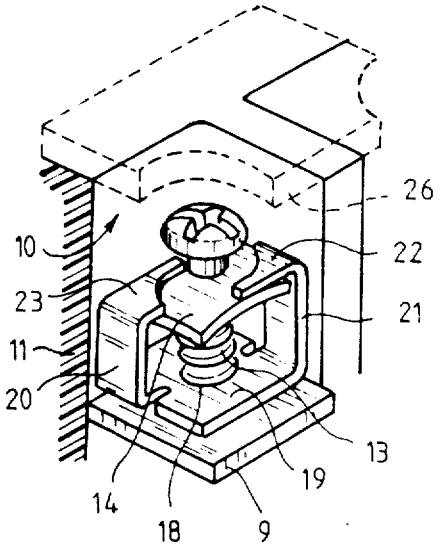
FIG. 5 is a perspective view of the elements shown in FIGS. 3 and 4 housed in a recess.
Figure 6:
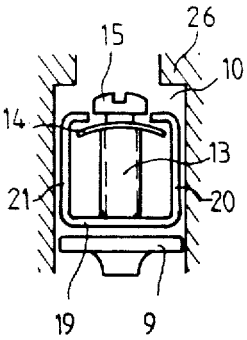
FIGS. 6 to 9 are schematical sections of the terminal of the type shown in FIGS. 3 to 5, for illustrating the operating principle of this terminal, more especially in its application to the connection of a closed connecting tag.

Such as shown in FIGS. 3 to 5, the connecting terminal comprises first of all a connection area 9, rectangular in shape, which is fixed by force fitting or by any other means into the bottom of a recess 10 formed in an insulating material body 11. This connection area 9, connected to the electric circuit of an apparatus, comprises a central tap or threaded bore 12 in which may be screwed the clamping screw 13 of the terminal. As already mentioned, this central bore 12 could be smooth and disposed at right angles to a tapped bore provided in body 11 or formed by a nut integral with body 11. In both cases, the length of the threaded portion must be sufficient for the number of threads engaged to provide efficient clamping of the connections.

Moreover, the clamping screw 13 is equipped with an elastic stirrup portion 14 of a curved shape, mounted so as to be unlosable under the head 15 of screw 13 (between head 15 and screw thread 16).

This screw 13 is further screwed, before engagement thereof in the connection area 9, into the threaded bore 18 of a stirrup-plate 19 of rectangular shape, made from thin and slightly resilient metal sheet.

In the example shown, the means for retaining the assembly formed by screw 13 and stirrup portion 14 consist of two tongues 20, 21 projecting at right angles from the stirrup-plate 19 at two diametrically opposite positions, adjacent two opposite corners of said stirrup-plate 19. These two tongues 20, 21 comprise at their end, at a given distance from the stirrup-plate 19, a part 22, 23 bent at right angles which extends in the direction of screw 13, as far as the passage volume of stirrup portion 14. The ends of these two tongues 22, 23 are cut in the shape of a circle 24 coaxial with the threaded bore 18 and which has a radius slightly greater than that of the head 15 of screw 13.

Recess 10 further comprises, at the level of its opening, an integrally formed narrowed portion or an added portion such as a terminal cover 26. This narrowed portion maintains the assembly formed by screw 13, stirrup portion 14, plate 19 and tongues 20, 21 in position inside the recess 10 while allowing it a predetermined axial play J.

Figure 7:
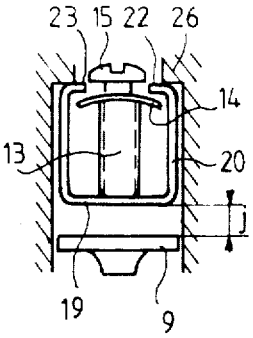

FIGS. 6 to 9 are for illustrating the operation of the above described terminal. Thus, in the example shown in FIG. 6, the screw in the unscrewed position is freed from the tapped thread 12 of the connection area 9, but is still engaged in the stirrup-plate 19. In this position, the stirrup portion 14 comes into abutment against the parts 22, 23 of tongues 20, 21 which are bent back at right angles so that screw 13 is immobilized. To arrive at this result, the height of the threaded portion of screw 13 must be substantially equal to the distance separating the stirrup-plate 19 from the parts 22, 23 bent back at right angles. In this position, the terminal is in the unscrewed state, where it is possible to fit conductors either into the gap between the stirrup-plate 19 and stirrup portion 14 or in the gap between the stirrup-plate 19 and the connection area 9. Thus, an appreciable advantage of the invention consists in the possibility of delivering the terminals in this unscrewed condition, so as to spare the user a further operation. In fact, up to present, so as to avoid loosing the screws, the terminals were always delivered in the clamped state. FIG. 7 illustrates the play j provided for the assembly formed by screw 13, stirrup portion 14, the stirrup-plate 19 and tongues 20, 21, when the terminal is in the unscrewed condition.

Figure 8:
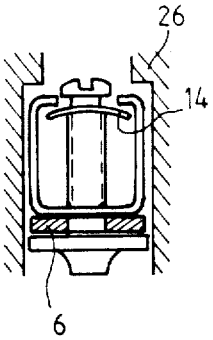
Figure 9:
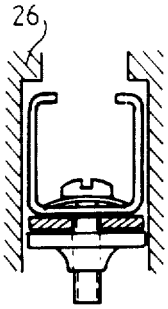
Figure 10:
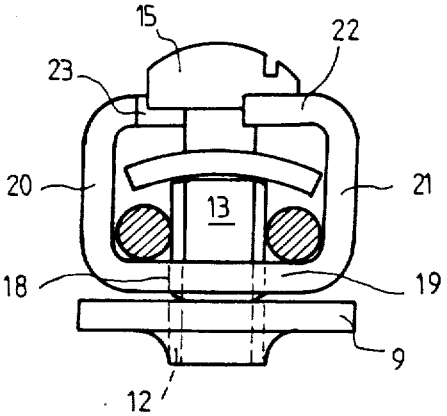
FIG. 10 is a side view of the assembly shown in FIGS. 3 and 4, this view illustrating another type of application of the terminal.

Because of this play, it is possible to fit one or more closed connecting tags 6 between the stirrup-plate 19 disposed in the raised position and the connection area 9, as shown in FIG. 8, a capacity of two connecting tags fitted head to tail may be advantageously provided. Similarly, the introduction of electric wires between stirrup portion (14) and the stirrup plate 19 in the way illustrated in FIG. 10 is considerably facilitated. It will be noted that the width of the closed connecting tag 6 used in FIG. 8 is essentially equal to the width of the recess 10, contrary to conventional cage fitting, the thickness of the cage playing no part.

Once the connecting tag or tags 6 are engaged, the thrust necessarily exerted during screwing up on the head of the screw by the screwdriver urges, through the stirrup-plate 19, the tag or tags 6 against the connection area 9 so as to arrive at the position shown in FIG. 8. Then screw 13 is screwed up tight, during which screw 13 passes through the bore 7 in tag 6 and is screwed into the threaded bore 12 in the connection area 9. It will be noted that this screwing up is performed without difficulty because screw 13, which is guided by the stirrup-plate 19, is presented strictly in the axis of the threaded bore 12 of the connection area 9. During all the screwing up, the relative distance between plate 19 and area 9 remains constant and equal to the thickness of connecting tags 6. With screwing up finished, the stirrup-plate 19 is freed from the threaded portion (part under head 15 of screw 13) and clamping is provided between the connection area 9 and the loss proof stirrup portion 14, the stirrup-plate 19 now only serving as a stress distributing washer (position shown in FIG. 9). When unscrewing, the resilience of the stirrup-plate 19 and of the stirrup portion 14 exerts on screw 13 a traction force allowing the tapped thread of the stirrup-plate 19 to be engaged again on the threaded portion of screw 13. To reach this result, it is suitable for the useful underhead clearance height h of the threads of screw 13 to be scarcely greater than the thickness of the stirrup-plate 19. The use of the above described terminal for clamping wires without preparation is obvious, as can be seen in FIG. 10. As mentioned above, the introduction of the ends of wires 30, 31 between the stirrup portion 14 and the stirrup-plate 19 is facilitated on the one hand, because of the fact that the screw is originally in an unscrewed position, and, on the other hand, because of the play provided for the mobile assembly 13, 14, 19, 20, 21, 22, 23 in recess 10. Here again the force exerted prior to screwing up causes the stirrup-plate 19 to be applied to the connection area 9. At the end of screwing up, the clamping reaction between stirrup portion 14 and the connection area 9 only causes the play in the threads between the stirrup-plate 19 and screw 13 to be taken up. Of course, the invention is not limited to the above described embodiments. It will in particular be noted that the retention means associated with the stirrup-plate may be in different forms.

Figure 11:
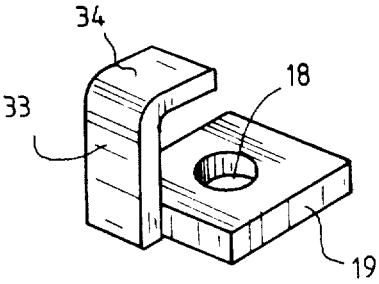
FIGS. 11, 12 and 13 show, in a perspective view, three variants of the retention means useful in a terminal of the invention.

They may for example consist, as shown in FIG. 11, of a single side tongue 33 projecting at right angles from the stirrup-plate 19 and having a bent portion 34 extending into the passage volume of the stirrup portion. In the example shown in this Figure, tongue 33 is adjacent a corner of the stirrup-plate 19. It is however clear that this tongue could just as well extend from a central zone on one side of the stirrup-plate.

Figure 12:
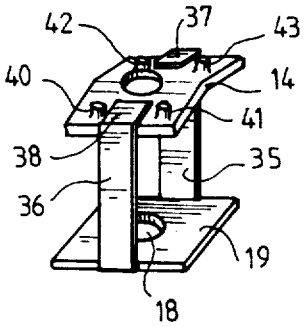

In the example shown in FIG. 12, the retention means comprise two tongues 35, 36 each having a bent in portion 37, 38 extending into the passage volume of the stirrup portion 14. These tongues 35, 36 are perpendicular to the stirrup-plate 19 and are ajoining two central zones on two opposite sides of said stirrup-plate 19. In this example, stirrup portion 14 comprises, projecting from its upper face, two pairs of bosses 40, 41, 42, 43 providing lateral holding thereof when it is in abutment against the bent in portions 37, 38 of tongues 35, 36.

Figure 13:
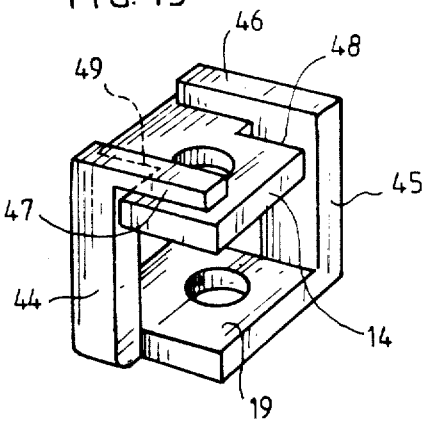

The retention means may further comprise, as shown in FIG. 13, two diametrically opposite tongues 44, 45, adjacent two opposite corners of the stirrup-plate 19 and perpendicular thereto, whose ends comprise two bent portions 46, 47, obtained for example by cutting out, which extend into the plane of tongues 44, 45, parallel to the stirrup-plate 19. In this case, the loss proof stirrup portion 14 has a rectangular shape of a width substantially equal to the distance separating the outer faces of the two tongues 44, 45 and is provided with two diametrically opposite rectangular cut outs 48, 49 for passing said tongues 44, 45 therethrough. This arrangement provides at the same time guiding of the stirrup portion 14 along tongues 44, 45.

What is claimed is:

1. A loss proof general purpose terminal for forming electric connections by clamping between two conducting elements, this terminal comprising:

an insulating material body;

a recess formed in said body and having guiding walls;

a connection plate disposed at the bottom of said recess;

a central bore formed in said connection plate;

Female screwing means formed in said central bore and having a screwing axis which extends parallel to said guiding walls;

a clamping screw mounted for passing through said bore and for being screwed into said screwing means, said clamping screw having a head, a thread portion and a smooth intermediate shank portion between said head and said thread portion;

a stirrup element having a bore through which passes said intermediate shank portion, said stirrup element being mounted on said intermediate shank portion;

a mobile assembly comprising a stirrup plate having a threaded bore through which said clamping screw is screwed, said stirrup plate having guiding surface portions cooperating with said guiding walls;

retaining means fitted on said stirrup plate and having an abutment surface portion against which the stirrup element comes to bear after unscrewing of said clamping screw from the connection plate, so that the clamping screw which is then still screwed in the threaded bore of the stirrup plate remains fixedly attached to said mobile assembly and is maintained, due to the cooperation of said guiding walls and said guiding portions, substantially coaxial with said screwing axis, whatever the position of said mobile assembly inside said recess.

2. The terminal as claimed in claim 1, wherein said stirrup-plate comprises two diametrically opposed lateral projecting arms extending at right angles to said stirrup-plate, said projecting arms forming a U shaped arrangement having two ends bent back inwardly and extending partially into the passage zone of said stirrup element.

3. The terminal as claimed in claim 1, wherein said stirrup plate comprises two diametrically opposite tongues extending perpendicularly to said stirrup-plate, said tongues having two bent portions extending in opposite directions into the plane of the tongues parallel to said stirrup-plate, and said stirrup element has two corresponding diametrically opposite cut outs for allowing said tongues to pass therethrough.

4. The terminal as claimed in claim 1, wherein said recess comprises a narrowed opening for preventing the mobile assembly formed by said screw, said stirrup-plate and said retaining means from escaping.

5. A loss proof terminal for forming electric connections by clamping between two conducting elements, this terminal comprising:

an insulating material body;

a recess formed in said body and having guiding walls;

a connection plate disposed at the bottom of said recess;

a central bore formed in said connection plate;

Female screwing means formed in said central bore and having a screwing axis which extends parallel to said guiding walls;

a clamping screw mounted for passing through said bore and for being screwed into said screwing means, said clamping screw having a head, a thread portion and a smooth intermediate shank portion between said head and said thread portion;

a stirrup element having a bore through which passes said intermediate shank portion, said stirrup element being mounted on said intermediate shank portion;

a mobile assembly comprising a stirrup plate having a threaded bore through which said clamping screw is screwed, said stirrup plate having guiding surface portions coperating with said guiding walls;

retaining means fitted on said stirrup plate and having an abutment surface portion against which the stirrup element comes to bear after unscrewing of said clamping screw from the connection plate, so that the clamping screw which is then still screwed in the threaded bore of the stirrup plate remains fixedly attached to said mobile assembly and is maintained, due to the cooperation of said guiding walls and said guiding portions, substantially coaxial with said screwing axis, whatever the position of said mobile assembly inside said recess, said clamping screw having a clearance height between head and screw thread in which, at the end of screwing up, the stirrup-plate frees itself from the screw thread and said stirrup-plate has a resilience so that at the beginning of screwing out this relilience exerts on said screw a traction force for reengaging the threaded bore of the stirrup-plate on said screw thread.

6. A loss proof terminal for forming electric connections by clamping between two conducting elements, this terminal comprising:

an insulating material body;

a recess formed in said body and having guiding walls a connection plate disposed at the bottom of said recess;

a central bore formed in said connection plate;

Female screwing means formed in said central bore and having a screwing axis which extends parallel to said guiding walls;

a clamping screw mounted for passing through said bore and for being screwed into said screwing means, said clamping screw having a head, a thread portion and a smooth intermediate shank portion between said head and said thread portion;

a stirrup element having a bore through which passes said intermediate shank portion, said stirrup element being mounted on said intermediate shank portion;

a mobile assembly comprising a stirrup plate having a threaded bore through which said clamping screw is screwed, said stirrup plate having guiding surface portions cooperating with said guiding walls;

retaining means fitted on said stirrup plate and having an abutment surface portion against which the stirrup element comes to bear after unscrewing of said clamping screw from the connection plate, so that the clamping screw which is then still screwed in the threaded bore of the stirrup plate remains fixedly attached to said mobile assembly and is maintained, due to the cooperation of said guiding walls and said guiding portions, substantially coaxial with said screwing axis, whatever the position of said mobile assembly inside said recess, said clamping screw having a clearance height between head and screw thread in which, at the end of screwing up, the stirrup-plate frees itself from the screw thread and said stirrup-plate has a resilience so that at the beginning of screwing out this relilience exerts on said screw a traction force for reengaging the threaded bore of the stirrup-plate on said screw thread, the useful said clearance height being slightly greater than the thickness of said stirrup-plate.

7. The terminal as claim 4, wherein said retaining means comprise at least one lateral arm projecting from said stirrup-plate, said projecting arm extending substantially at right angles to said stirrup-plate and having a bent back portion extending into the passage zone of said stirrup element, so as to limit the axial travel of said stirrup element at the end of screwing out, when said screw is freed from the said female screwing means.

* * * * *